United States Patent [19]

Polacek

[11] Patent Number: 4,962,644

[45] Date of Patent: Oct. 16, 1990

[54] VIBRATING ROLL APPARATUS

[75] Inventor: Manfred Polacek, Munich, Fed. Rep. of Germany

[73] Assignee: Wacker Werke GmbH & Co. KG, Munich, Fed. Rep. of Germany

[21] Appl. No.: 310,421

[22] Filed: Feb. 13, 1989

[30] Foreign Application Priority Data

Feb. 13, 1988 [DE] Fed. Rep. of Germany ..... 3804620

[51] Int. Cl.[5] ..... F16D 31/02

[52] U.S. Cl. ..... 60/435; 60/468; 60/488; 60/494

[58] Field of Search ..... 417/223, 313; 60/435, 60/436, 437, 488, 487, 468, 494

[56] References Cited

U.S. PATENT DOCUMENTS

| | | | |
|---|---|---|---|
| 3,555,817 | 1/1971 | Hann | 60/468 X |
| 3,581,498 | 6/1971 | Cudnohufsky | 60/468 X |
| 4,015,482 | 4/1977 | Ito et al. | 60/437 X |
| 4,087,969 | 5/1978 | Takahashi et al. | 60/488 X |
| 4,203,710 | 5/1980 | Farr | 417/313 X |
| 4,317,331 | 3/1982 | Aruga et al. | 60/436 |
| 4,689,955 | 9/1987 | Lietzke | 60/488 X |
| 4,737,079 | 4/1988 | Kurosawa et al. | 417/223 X |
| 4,773,217 | 9/1988 | Angot et al. | 60/444 |

*Primary Examiner*—Edward K. Look

*Attorney, Agent, or Firm*—Herbert Dubno

[57] ABSTRACT

The vibrating roll apparatus has a hydrostatic roll body drive drive. An internal-combustion engine drives a pump unit which includes an inclined disk pump of variable displacement and a filling pump. At least one hydraulic drive motor which is fed a pressurized medium by the inclined disk pump powers the hydrostatic roll body drive. An eccentric body in the roll body of the vibrating roll is driven by a mechanical power transmission device with a built-in clutch also powered by the internal-combustion engine. According to the invention the clutch is flanged to the pump unit and provided with a hydrostatically-operated clutch mechanism, which is connectable with the pressurized side of the filling pump by a clutch valve for engagement of the clutch. In this way a space-saving compact form for the drive for the eccentric body including means for its control with optimum conditions for clutch operation is attained.

1 Claim, 3 Drawing Sheets

VIBRATING ROLL APPARATUS

FIELD OF THE INVENTION

My present invention relates to a vibrating roll and a mechanism or apparatus for driving it.

BACKGROUND OF THE INVENTION

A vibrating roll apparatus with a hydrostatic roll body drive driven by at least one hydraulic drive motor is known. The hydraulic drive motor is connected to a driven adjusting pump of variable displacement. This adjusting pump is driven by an internal-combustion engine, especially a diesel engine, and is controllable by an operator. The pump is constructed as an inclined disk (axial-piston or swashplate) pump with a filling pump for the intake stroke of the displaced piston.

A vibrating eccentric body in the vibrating roll is drivable by a special force transmission device with a built-in clutch operable by the operator at least partially driven by the drive shaft of the internal-combustion engine.

A vibrating roll apparatus of the above-described type is known. It is manufactured and marketed by the assignee hereof and is described in a brochure (W 680/12-10 -10.87 of October 1987).

In the known vibrating roll apparatus the clutch is operated mechanically. The mechanical operating mechanism and the coupler provided for mechanical operation are bulky so that a second driven shaft or output member on the internal-combustion engine was required on the side opposite the adjusting pump and there the engine shaft must also be extended. Furthermore the clutch operated directly by an operator by a clutch rod has the disadvantage that there is no guarantee that it can be carefully operated, i.e. so as to be largely slip-free.

OBJECTS OF THE INVENTION

It is an object of my invention to provide a vibrating roll apparatus of the above-described type, in which operator errors due to manual clutch operation are eliminated.

It is another object of my invention to provide a vibrating roll apparatus of the above-described type, in which the clutch is arranged in a space-saving compact structure on the same side as the adjusting pump without the necessity of extending the engine shaft on both sides of the internal-combustion engine.

SUMMARY OF THE INVENTION

These objects and others which will become more readily apparent hereinafter are attained in accordance with my invention in a vibrating roll apparatus of the above-described type.

According to my invention, the clutch is flanged to a pump unit including the filling pump and the adjusting pump and the input member of the clutch is coupled with a pump shaft of the pump unit. The clutch has a hydrostatically operable clutch mechanism which is connectable selectively with the pressurized side of the filling pump or with the sump of the pump unit by a clutch valve operable by the operator.

Hydraulically operable clutches are, of course, generally known. They have a smaller space requirement than mechanically-operable coupling devices and can be easily operated by a space-saving pressurized-medium line practically at any desired location in the vibrating roll apparatus.

It is a disadvantage, however, that they require a hydraulic pressure transmission device. The pressurized-medium line system of the adjusting pump has not been suitable up to now because of the special pressure conditions resident in it, especially pressure fluctuations down at the idle pressure, so that the hydraulically operated clutch used up to now required comparatively more space.

My invention is based on the discovery that the filling pump connected together with the adjusting pump in a pump unit can be used as a pressure transmission device for the clutch, if its pressurized medium line system integrated in the pump unit is made accessible from the outside.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
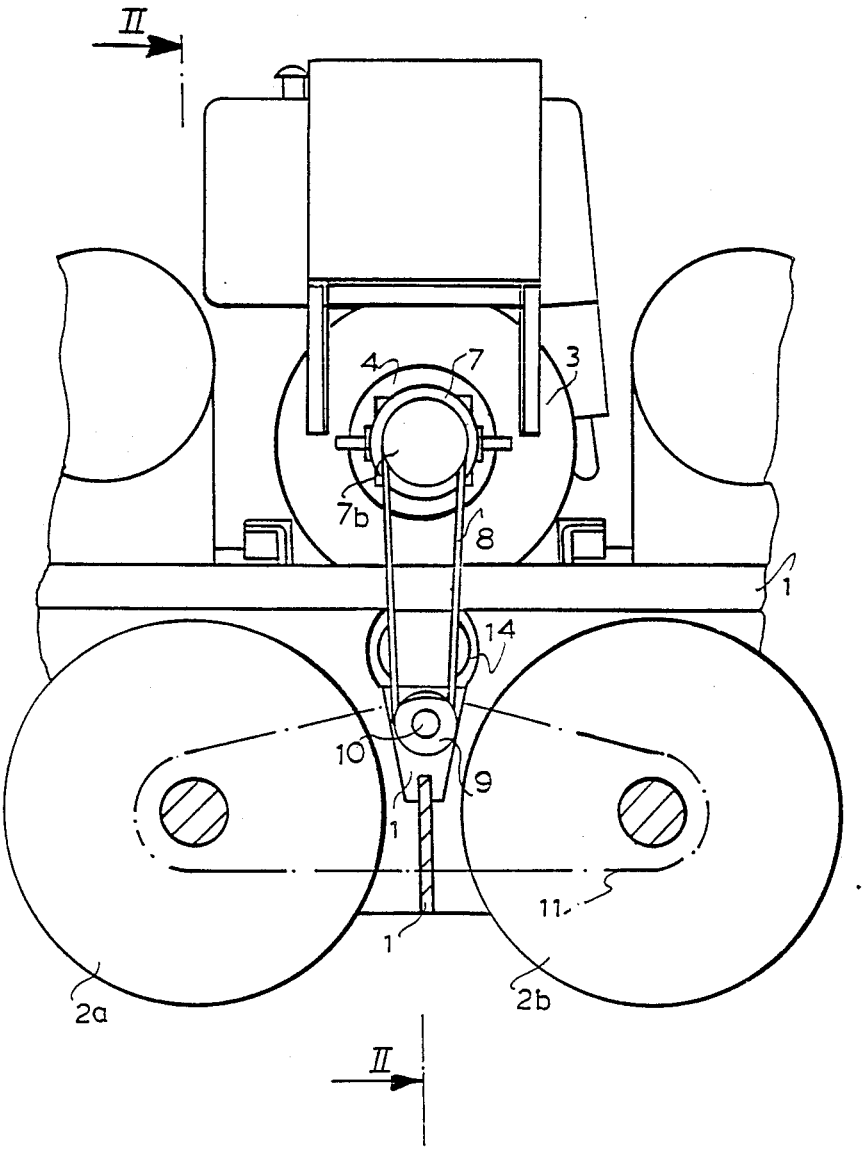
FIG. 1 is a side-elevational view of a vibrating roll apparatus according to my invention in which the parts protruding beyond the roll bodies parallel to the travel direction are omitted.
Figure 2:
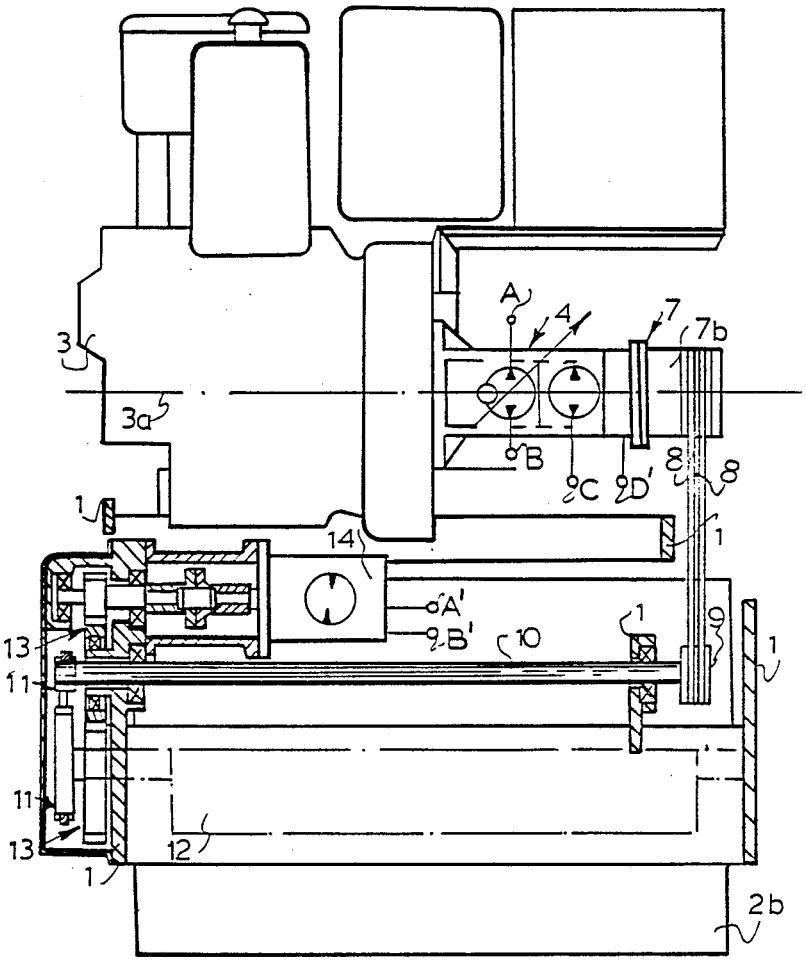
FIG. 2 is a cross-sectional view through the vibrating roll apparatus taken along the section line II—II in FIG. 1.

The vibrating roll apparatus shown in FIGS. 1 and 2 has a rigid mounting frame 1 in which front and rear roll bodies 2*a* and/or 2*b* are mounted rotatably but are not guided by the frame.

An internal-combustion engine 3, here a diesel engine, is attached to the mounting frame 4 and has a motor shaft 3*a* positioned parallel to the roll body axis so that the engine protrudes on the left side of FIG. 2 (viewer's left), but not beyond the remaining parts of the vibrating roll apparatus.

The engine 3 extends over about half the width of the rolls so that a free or empty space extending from it over the other half of the rolls to the lateral roll limit is likewise present on the right side of FIG. 2 (viewer's right).

The engine shaft 3*a* is extended from the engine 3 only on this right side and there drives a pump unit 4 with a pump shaft 4*a* coaxial with it. The pump unit comprises a filling pump 6 and an axial-piston inclined-plate or swashplate pump 5 of variable displacement and reversible pump direction.

The pump unit 4 is flanged (i.e. connected by flange means 4*b*) directly to the engine 3. On the far side from the engine 3 the pump shaft 4*a* of the pump unit 4 is guided or extended from it and drives the input member 7*a* of a hydraulically operated clutch 7 which has an output member 7*b* constructed like a drum and for its part is flanged to the pump unit 4. In the drawing the chief exterior connections of the adjusting pump 5, which make the pressurized and the low-pressure connections in an interchangeable way, are indicated with an A and B.

An additional pressurized medium connector extended from the pump unit 4 is connected with the permanently pressurized side of the filling pump 6.

The clutch 7 has a single pressurized medium connector D'; when this is pressurized hydraulically, the clutch 7 is engaged so that then, and only then, the input member 7a of the clutch 7 is connected nonrotatably with its output member 7b.

The drum-shaped output member 7b of the hydraulically operable clutch 7 is provided with grooves in which V-belt 8 runs which drives a V-belt pulley 9 at one end of an intermediate shaft 10 which extends parallel to the engine shaft 3a under the engine 3 from the right side (observer's right) of the vibrating roll apparatus and is rotatably mounted in the mounting frame 1 in the vicinity of the ends.

In this way, the drive moment of the clutch 7 is transferred to the other side of the vibrating roll apparatus and there drives the vibrating eccentric bodies 12 in the roll bodies 2a and 2b by a V-belt belt drive 11 indicated only schematically in the drawing.

A hydraulic drive motor (e.g. an axial-piston motor) 14 of fixed displacement attached between the roll bodies under the diesel engine 3 on the roll mounting frame 1 has two conventional pressurized medium principal connectors A' and B'and provides for the rotation of the roll bodies 2a and 2b by a gear 13 indicated only schematically in FIG. 2 of the drawing.

Figure 3:
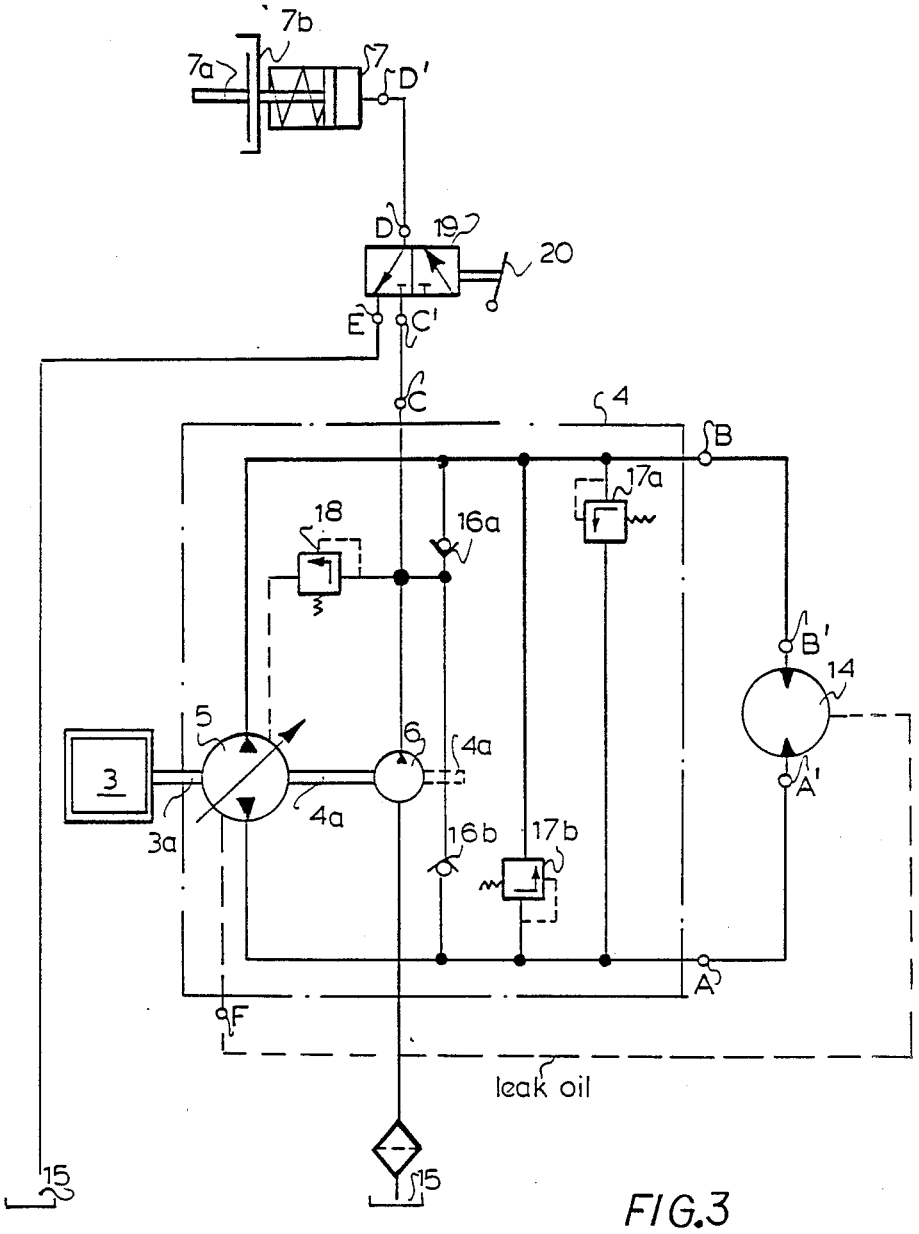
FIG. 3 is a schematic diagram of the hydraulic line system in the vibrating roll apparatus of FIGS. 1 and 2.

As shown in FIG. 3 the principal connectors A' and B' are connected with the chief connectors A and/or B respectively of the adjusting pump 5 by pressurized medium lines not shown in FIG. 2.

The rotation speed and the rotation direction of the hydraulic drive motor 14 depend on the pumping speed, i.e. the volume pumped per unit time, and the pumping direction of the adjusting pump 5 and determines the travel speed and/or the travel direction of the vibrating rolls.

FIG. 3 shows the circuit diagram for the hydraulic line system in the vibrating roll apparatus of FIGS. 1 and 2. The hydraulic connections indicated in FIG. 2 with large reference characters in the pump unit 4, the clutch 7 and the hydraulic drive motor 14 are indicated with the same reference characters.

The adjusting pump 5 and the filling pump 6 are connected together in the customary way. The suction or low-pressure side of the filling pump 6 is connected with an oil supply reservoir 15 (sump). Its pressurized side is connected by a nonreturn valve 16a and/or 16b to the one and/or the other of both of the connecting lines integrated in the pump unit 4 leading to the connectors A and B of the adjusting pump 5.

The nonreturn or check valves 16a and 16b open in the direction of these connecting lines so that a permanent filling of the pressurized medium-principal line system between the adjusting pump 5 and the hydraulic drive motor 14 extending to the connectors A, A', B and B' is guaranteed and the piston heads of the adjusting pump are maintained continuously under a certain pressure in contact with their inclined disks.

Pressure-limiting valves 17a and 17b limit the maximum pressure which can occur in the pressurized branch of the hydraulic principal line system between the adjusting pump 5 and the hydraulic drive motor 14.

The maximum pressure in the pressurized hydraulic circuit of the filling pump 6 is bounded by a pressure limiting valve 18. The connecting lines shown dashed in FIG. 3 are relief and/or leak oil lines which lead back to the reservoir or sump 15. According to the inclination of the inclined disk the adjusting pump 5 makes the pressurized branch extending from the connection A and the low-pressure or suction branch the branch extending from the connection A or the reverse.

The rotation speed of the hydraulic drive motor 14 depends on the pumping speed of the adjusting pump which is selectable by the inclination angle of the inclined disk.

The pressure in the pressurized branch of the principal-pressurized medium line system adjusts itself to the highest allowed value according to the travel resistance, which acts on the shaft of the hydraulic drive motor 14, subject also to considerable fluctuations, which is held above the pressure of the filling pump 6 predetermined by the limiting valve 18 by the nonreturn valves 16a and 16b so that the filling pump pressure has an approximately constant value.

The previously-mentioned connecting paths with the built-in valves in the pump unit 4 are integrated in a unit bounded with the connectors A and B and the connector F for the outer relief and leak oil lines. Moreover, an outlet duct is provided additionally in the pump unit 4, which connects the pressurized side of the filling pump 6 with the outer pressurized medium connector C. This connector C is connected by an exterior connecting line to the one entrance connector C' of a clutch valve 19 having two connecting positions.

This clutch valve has a second pressurized medium connector E which is connected with the sump 15.

A third pressurized medium connector D of the clutch valve 19 is connected by another pressurized line with the pressurized medium connector D' of the clutch 7. Both clutch positions of the clutch valve 19 are selectable by a lever 20, which, like the clutch valve 19, is mounted on the vibrating roll apparatus and is located in the accessible vicinity of the roll guides.

In one position, the clutch valve 19 closes the pressurized medium connector C' and connects the connectors D and E, while it closes the connector E in the other clutch position and connects the connectors C' and D.

In the first-mentioned clutch position accordingly the connector D' is depressurized and thus the clutch coupling is broken, and in the second-mentioned clutch position the connector D' of the filling pump 6 is pressurized so that the clutch coupling is made, i.e. the clutch 7 is engaged, and a nonrotatable connection between the input member 7a and the output member 7b is made and the diesel engine 3 then also drives the vibrating eccentric body 12 in the roll bodies 2a and 2b.

By the direct flanging together of the engine 3, the pump unit 4 and the clutch 7, which is possible by the use of a hydraulically operable clutch close coupled to a filling pump used as a pressurized medium source, a safe compact structure of minimal troublesomeness results with optimum operability. Its spatial requirements are not excessive. Then it can be easily accommodated inside the available roll width in front of the diesel engine 3, when it is displaced or staggered laterally relative to the roll center, which is possible because of the unused front side of the engine on the other side of it.

I claim:

1. A vibrating-roll apparatus, comprising:

a mounting frame;

a pair of vibratable rolls received in said mounting frame;

respective eccentric bodies received in said rolls;

a driven shaft mounted on said frame and having a driven-shaft axis parallel to axes of said rolls;

a hydraulic motor on said frame having a motor axis parallel to said driven-shaft axis;

means on said frame operatively connecting said hydraulic motor to said rolls for driving same;

means on said frame operatively coupling said driven shaft to said eccentric bodies at one end of said driven shaft for actuating said eccentric bodies to vibrate said rolls;

an engine mounted on said frame in a region of said one end and having a drive shaft with a drive-shaft axis parallel to said driven shaft axis, said engine being so positioned on said frame that a space is formed between said engine and a side of said frame in a region of an opposite end of said driven shaft;

a variable-displacement inclined-disk pump connected directly by a flange means with said engine in said space and along said drive shaft, said variable-displacement inclined-disk pump being driven directly by said drive shaft and being hydraulically connected to said motor for driving same;

a filling pump connected directly with said variable-displacement inclined-disk pump in said space and along said drive shaft, said filling pump being driven directly by said drive shaft and being hydraulically connected to said variable-displacement inclined-disk pump to supply said variable-displacement inclined-disk pump with hydraulic medium at all time during operation of said engine;

a hydraulically controlled clutch connected directly by a flange means with said filling pump in said space and along said drive shaft, said clutch being driven directly by said drive shaft and having an output element rotatable about said drive-shaft axis;

means on said frame operatively coupling said output element with said other end of said driven shaft for rotating same; and a control valve hydraulically connected between said variable-displacement inclined-disk pump and said clutch for selectively operating said eccentric bodies.

* * * * *